US006397414B1

(12) United States Patent
Lloyd

(10) Patent No.: US 6,397,414 B1
(45) Date of Patent: Jun. 4, 2002

(54) ADJUSTABLE FACE REST

(76) Inventor: John T. Lloyd, 80926 Turkey Run Rd., Creswell, OR (US) 97426

( * ) Notice: Subject to any disclaimer, the term of this patent is extended or adjusted under 35 U.S.C. 154(b) by 0 days.

(21) Appl. No.: 09/599,290

(22) Filed: Jun. 21, 2000

(51) Int. Cl.[7] ..... A47C 20/02; A61G 15/00

(52) U.S. Cl. ..... 5/622; 5/638; 5/640; 5/643; 297/900

(58) Field of Search ..... 5/622, 638, 640, 5/643, 725, 652.1; 128/845, 202.18; 297/900

(56) References Cited

U.S. PATENT DOCUMENTS

| | | | | |
|---|---|---|---|---|
| 1,009,417 | A | | 11/1911 | John |
| 1,629,306 | A | | 5/1927 | Reeder |
| 1,728,025 | A | | 9/1929 | Weber |
| 2,461,434 | A | | 2/1949 | Moyers |
| 2,463,410 | A | | 3/1949 | Morris |
| 2,568,417 | A | | 9/1951 | Steinbacher |
| 2,661,050 | A | | 12/1953 | Felter |
| 3,477,761 | A | | 11/1969 | Krantz |
| 3,572,835 | A | | 3/1971 | Kees et al. |
| 3,603,642 | A | | 9/1971 | Laessker |
| 3,761,128 | A | | 9/1973 | Schenk et al. |
| 3,858,937 | A | | 1/1975 | Norris |
| 4,139,093 | A | | 2/1979 | Holmes |
| 4,779,297 | A | | 10/1988 | Sturges |
| 5,127,823 | A | | 7/1992 | Bonner |
| 5,177,823 | A | | 1/1993 | Riach |
| 5,233,713 | A | | 8/1993 | Murphy et al. |
| 5,276,927 | A | | 1/1994 | Day |
| 5,347,668 | A | | 9/1994 | Manning |
| 5,427,436 | A | | 6/1995 | Lloyd |
| 5,970,546 | A | | 10/1999 | Danis |
| 6,151,734 | A | * | 11/2000 | Lawrie ..... 5/622 |
| 6,276,012 | B2 | * | 8/2001 | Borders ..... 5/622 |

FOREIGN PATENT DOCUMENTS

| | | |
|---|---|---|
| GB | 935969 | 9/1963 |
| GB | 2161702 | 1/1986 |

* cited by examiner

*Primary Examiner*—Michael F. Trettel
(74) *Attorney, Agent, or Firm*—Kolisch, Hartwell, Dickinson, McCormack & Heuser

(57) ABSTRACT

An adjustable face rest for use with massage equipment such as tables and chairs includes at least one handle for locking or unlocking adjustability of the face rest. A cross support member is bent or curved to avoid encroaching a person's chin.

23 Claims, 4 Drawing Sheets

ADJUSTABLE FACE REST

FIELD OF THE INVENTION

The invention relates to face rests that are mounted on a chair or a table. In particular, the invention involves a face rest that is adjustable for supporting a person's head in different orientations.

BACKGROUND OF THE INVENTION

Adjustable face rests are commonly used on tables and chairs that are designed to support a person's body while the person receives a massage or other type of body-working therapy. Examples of portable massage tables that use adjustable face rests are shown in U.S. Pat. Nos. 5,676,062 and 5,913,271. Examples of adjustable face rests are shown in U.S. Pat. Nos. 5,427,436 and 5,177,823. Each of the patents listed above is incorporated herein by reference.

Face rest designs such as those shown in U.S. Pat. Nos. 5,427,436 and 5,177,823 are popular because freedom to adjust the face rest can be controlled using a minimal number of toggles or levers. However, a problem with these face rest designs is that they require a rigid cross support in a location that may interfere with a person's chin. Accordingly, there is a need for an adjustable face rest design that provides autonomous lock control from one or two handles, with comfortable facial support that does not hit or encumber a person's chin.

SUMMARY OF THE INVENTION

Problems with the prior art are solved by the present invention which provides an adjustable device for supporting a person's head. A facial support member has a proximal end. A linkage device is configured to secure the support member to a furniture item such as a chair or a table. The support member is free to rotate around a rotational axis located near the proximal end of the support member. Plural cooperative clamping devices are laterally spaced from each other along the rotational axis. The clamping devices are connected by a cross-member that is angled or curved to avoid interfering with a person's chin. A single handle or lever is provided for operating plural clamping devices simultaneously.

DESCRIPTION OF PREFERRED EMBODIMENTS OF THE INVENTION

The invention provides apparatus for supporting a person's body, particularly including adjustable face rest support that avoids encumbering a person's chin.

Figure 1A:
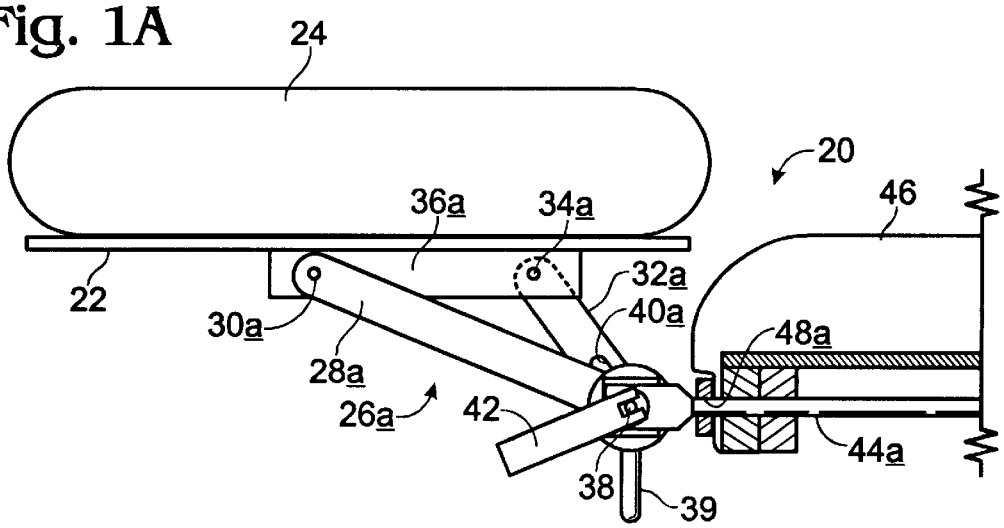
FIGS. 1A–1C are side views of an adjustable face rest in a preferred embodiment of the invention, showing different orientations of the face rest relative to a table.
Figure 1B:
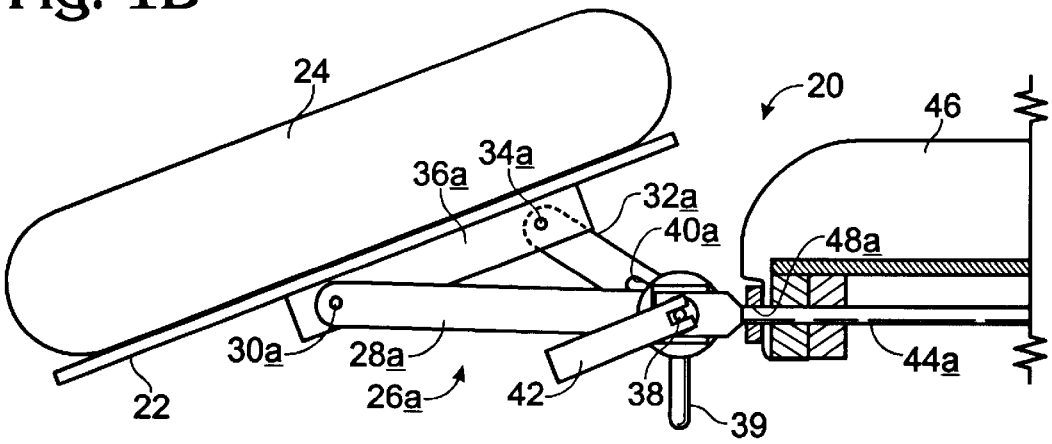
Figure 1C:
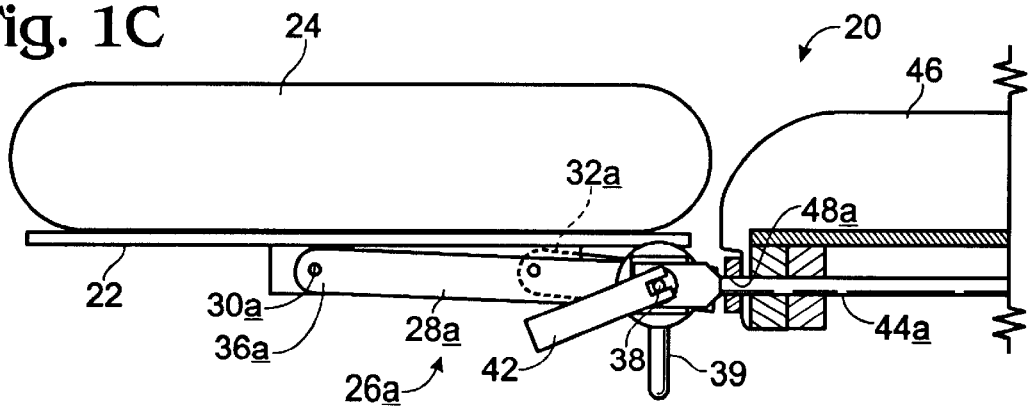

FIGS. 1A, 1B and 1C illustrate a face rest, in accordance with a preferred embodiment of the present invention, in three orientations relative to a massage table. In FIG. 1A, the face rest 20 includes base plate 22 which supports a pad or cushion 24. It is not necessary for the base to be in a plate form. A satisfactory "base" may take many different forms, i.e., practically any rigid frame structure which is capable of supporting a person's head. Base plate 22 is supported on its bottom side by triangular support structure 26*a*, also referred to as an arm assembly. Arm assembly 26*a* consists of long arm 28*a* pivotally connected to distal junction 30*a*, and short arm 32*a* pivotally connected to proximal junction 34*a*. Distal and proximal junctions 30*a* and 34*a* define a line that is approximately parallel to the plane of the paper that the figure is drawn on. Proximal and distal junctions 30*a* and 34*a* should be positioned in a fixed orientation near and relative to the bottom side of base plate 22. Distal and proximal junctions 30*a* and 34*a* are defined by holes in elongated flange 36*a* attached to the bottom side of base plate 22.

Arms 28*a* and 32*a* are commonly and pivotally attached to cross support member 38. Cross support member 38 includes a bent cover tube portion 39 that is designed to avoid interference with a person's chin.

Each of arms 28*a* and 32*a* have an effective length relative to the triangle formed by the two arms and the portion of the base plate between the junctions. At least one of the arms, for example, short arm 32*a* in FIG. 1A, has a slot 40*a* through which cross support member 38 passes. A clamp, operated by cam lever 42 is manipulable between a lock-position and a release-position. When the clamp is in the release-position, the arms are free to pivot around cross support member 38, and the effective length of short arm 32*a* is adjustable by moving slot 40*a* relative to cross support member 38. When cam lever 42 moves to set the clamp in its lock-position, all pivotal movement of arms 28*a* and 32*a* about cross support member 38, and effective length adjustment of short arm 32*a*, is prevented.

Pivoting movement of the arms around cross support member 38 is alternately prevented then allowed by, respectively, engaging then disengaging corresponding serrated faces on opposing discs. The disc structures will be described in more detail below. In contrast, adjustment of the effective length of short arm 32*a* is controlled by alternating between two degrees of friction applied to arm 32*a* in the vicinity of slot 40*a*. When the clamp is in the lock-position, as more clearly illustrated in FIG. 2, short arms 32*a* and 32*b* are frictionally sandwiched between washers, thereby preventing effective length adjustment of the short arm. When the clamp is in the release-position, the degree of friction exerted on the short arms by their respective pairs of washers, is lessened to an appropriate degree so that adjustment of the effective lengths of the short arms is permitted, however, a small degree of residual friction remains so that the face rest does not "flop". In other words, even when the clamp is in the release-position, the geometry of the triangular support structure will not change unless manual pressure is exerted on the face rest by the user.

A post 44*a* is also connected to cross support member 38 and is free to pivot relative to cross support member 38 when the clamp is in the release-position. Table 46 has a hole 48*a* through which post 44*a* can be inserted, thereby securely attaching the face rest 20 to the table 46.

FIGS. 1B and 1C show the same parts as FIG. 1A, however, the relative positions of the parts have been altered in order to illustrate the adjustability of face rest 20. In FIG.

1A base plate 22 and pad 24 of face rest 20 are elevated and substantially parallel to table 46. In FIG. 1B the average height of face rest 20 is approximately the same as table 46, however, the angle of face rest 20 has been adjusted substantially. The geometry of triangular support structure 26*a* in FIGS. 1A and 1B is substantially unchanged, however, the orientation of triangular support structure 26*a* relative to table 46 has been rotated around cross support member 38. It is also apparent in FIGS. 1A, 1B and 1C that the height and angular orientation of face rest 20 directly tracks the orientation of a line including the proximal junction 34*a* and the distal junction 30*a*. FIG. 1C shows the orientation of face rest 20 when triangular support structure 26*a* is essentiially collapsed. This allows face rest 20 to be placed in a substantially level and parallel orientation relative to table 46.

FIGS. 1A, 1B and 1C illustrate an important structural feature of the invention, namely, the reinforced coupling arrangement of long arm 28*a* and short arm 32*a* between table 46 and face rest 20. By cooperatively employing two coupling arms in connection with proximal and distal junctions, respectively, particularly when tandem triangular support structures are used under opposing lateral portions of the face rest, a greater degree of strength and sturdiness of the face rest relative to the table is achieved in comparison to prior face rests.

Figure 2:
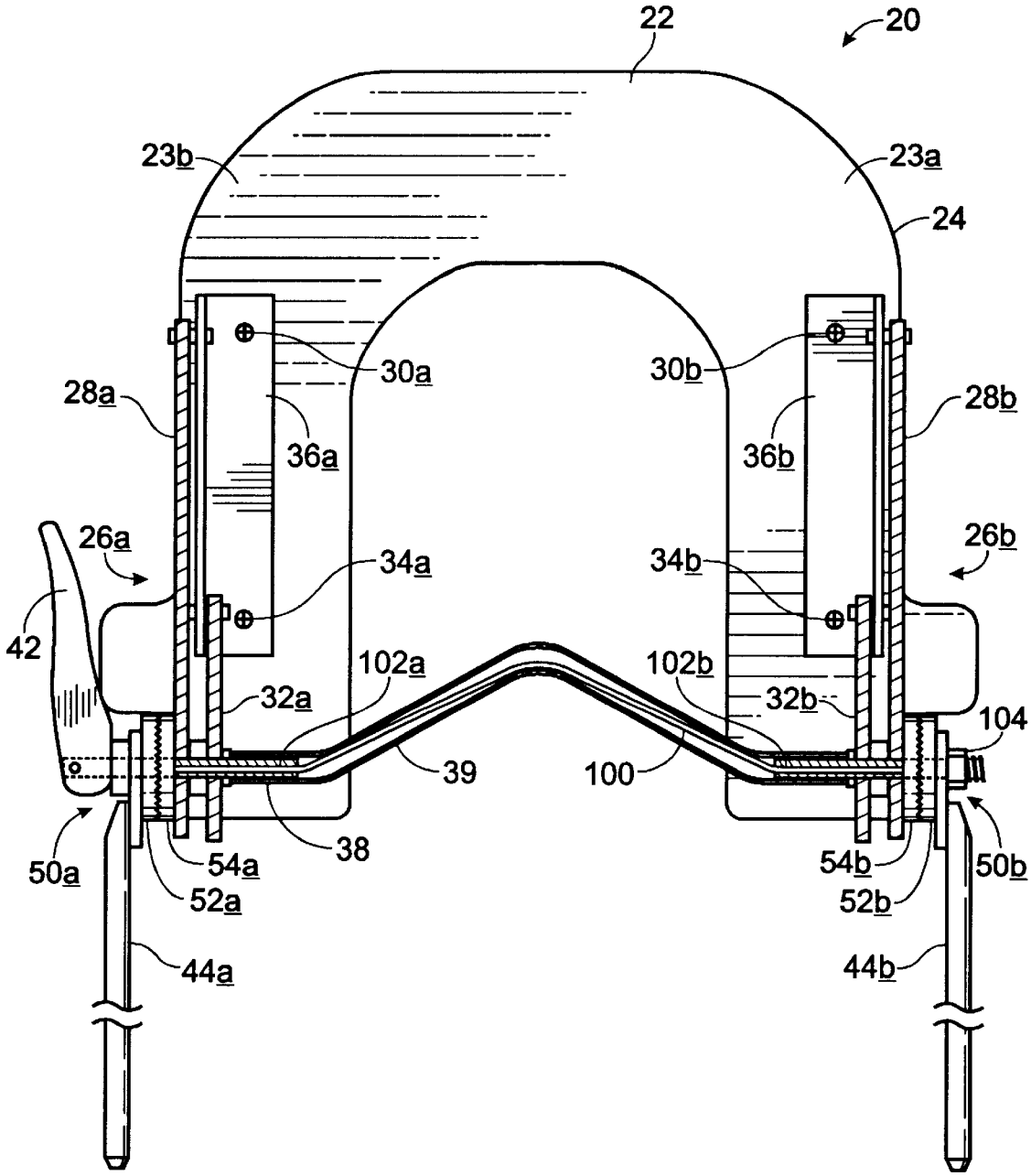
FIG. 2 is a bottom view of the adjustable face rest shown in FIG. 1.

FIG. 2 shows two triangular support structures 26*a* and 26*b*. Each of lateral portions 23*a* and 23*b* of base plate 22 have a triangular support structure attached to the bottom side. Triangular support structures 26*a* and 26*b* are practically the same. Elements of triangular support structure 26*b* are generally the same as elements of triangular support structure 26*a*. Unless otherwise indicated, everything discussed and illustrated in the application relative to one of the triangular support structures, applies to both triangular support structures.

Each triangular support structure has a clamp 50*a* or 50*b*, both of which are engaged and disengaged concertedly between lock-positions and release-positions, respectively, by movement of cam lever 42. Clamp 50*a* includes two discs 52*a* and 54*a* with serrated faces juxtaposed with each other. The rotational position of disc 52*a* relative to cross support member 38 is at all times linked with the orientation of post 44*a*. The rotational position of disc 54*a* relative to cross support member 38 is at all times linked to the rotational position of triangular support structure 20*a*, so that when cam lever 42 is in the release-position, triangular support structure 26*a* may freely rotate relative to post 44*a*. However, when cam lever 42 is moved to the lock-position, the serrated faces of discs 52*a* and 54*a* engage, thereby preventing relative movement between the angular orientation of triangular support structure 26*a* and post 44*a*. All of the discussion concerning clamp 26*a* is equally descriptive of clamp 26*b*.

Bent cover tube portion 39 of cross support member 38 conceals cable 100. One end of cable 100 is secured to rod end piece 102*a*. Rod end piece 102*a* is connected to cam lever 42. Rod end piece 102*a* moves longitudinally relative to discs 52*a*, 54*a*, and bent cover tube portion 39 when cam lever 42 is manipulated. Similarly, the other end of cable 100 is secured to rod end piece 102*b*. Rod end piece 102*b* passes through discs 42*b*, 54*b*, and bolt 104. Collectively, cable 100, rod end pieces 1024*a*, 102*b*, and bent cover tube portion 39 function to force engagement of each pair of discs when cam lever 42 is positioned, as shown in FIG. 2, retracting rod end piece 102*a*. When cam lever 42 is flipped to the other side, rod end piece 102*a* moves inward, decreasing tension on cable 100 and allowing each pair of discs to disengage.

Bent cover tube portion 39 may be substituted with other similarly-shaped rigid structures. For example, a rod may be used with a groove to hold and guide cable 100. In essence, any type of rigid angled or curved structure that is capable of holding and guiding cable 100 may be used instead of bent cover tube portion 39.

Other details of the adjustment mechanisms employed in the face rests shown in FIGS. 1A–C and FIG. 2, are explained and illustrated in U.S. Pat. No. 5,427,436.

Figure 3:
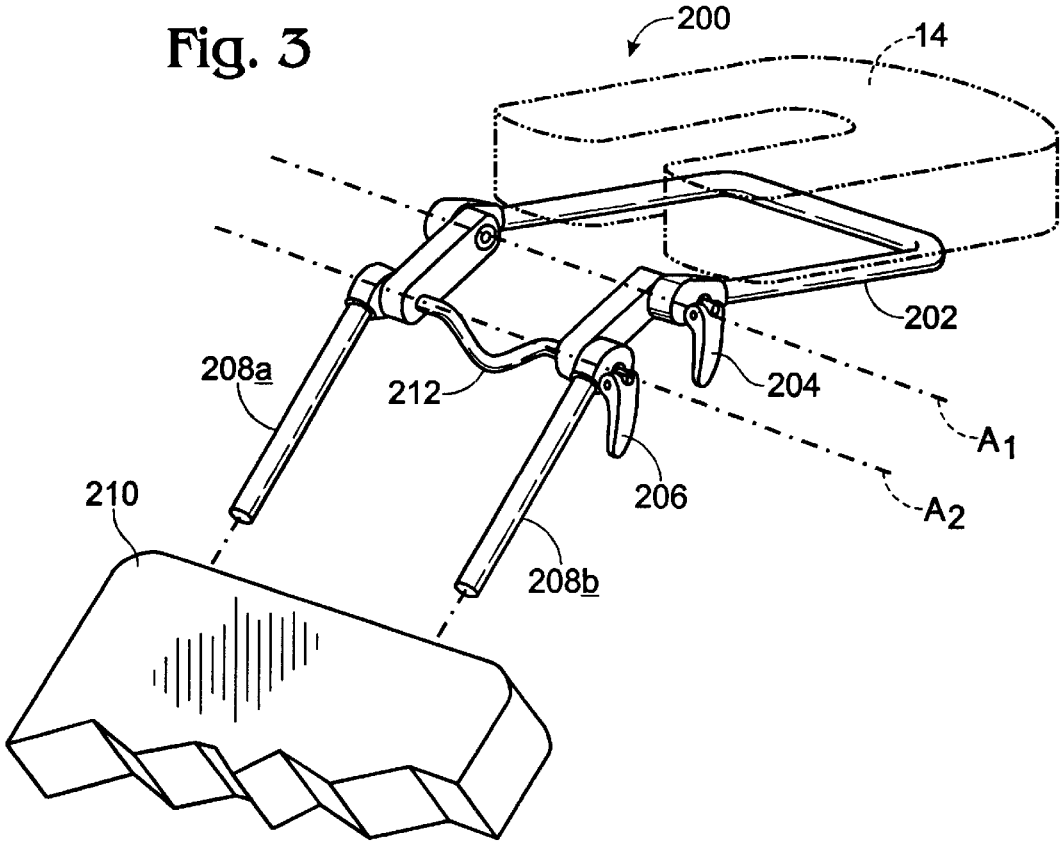
FIG. 3 is a perspective view of an alternative embodiment of the invention.

FIG. 3 illustrates an alternative adjustable face rest 200. Details of the adjustment mechanisms employed in face rest 200 are described and illustrated in U.S. Pat. No. 5,177,823. Rigid frame member 202 supports U-shaped pad 14. Cam lever 204 alternately locks and unlocks freedom of rotational movement of frame structure 202 around axis A1. Cam lever 206 alternately locks and unlocks freedom of rotational movement of frame structure 202 around axis A2. Posts 208*a* and 208*b* fit into holes in a table or chair 210. In accordance with principles discussed above with reference to FIGS. 1A–C and FIG. 2, bent cross member 212 is curved to avoid interference with a person's chin.

Figure 4:
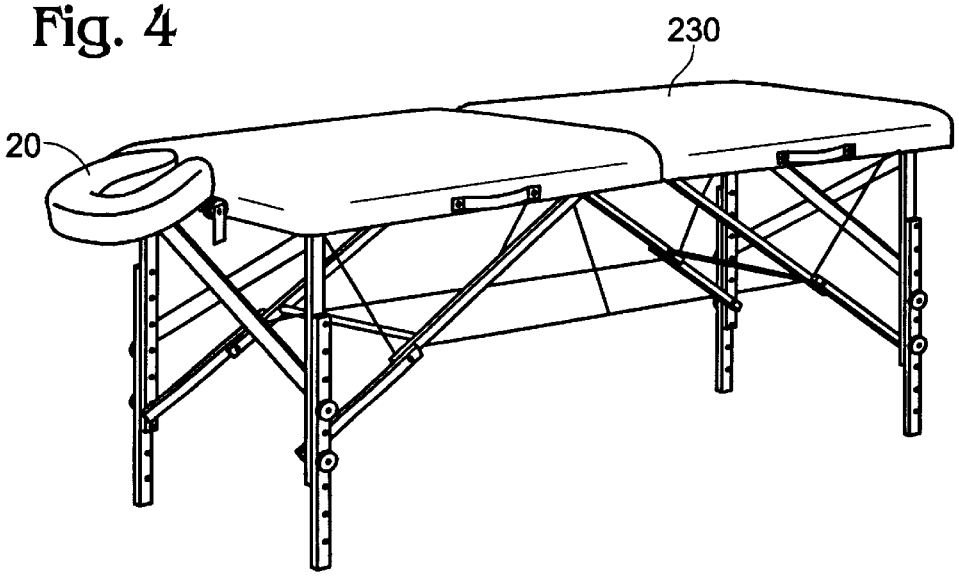
FIG. 4 is a perspective view of an adjustable face rest mounted on a collapsible massage table.
Figure 5:
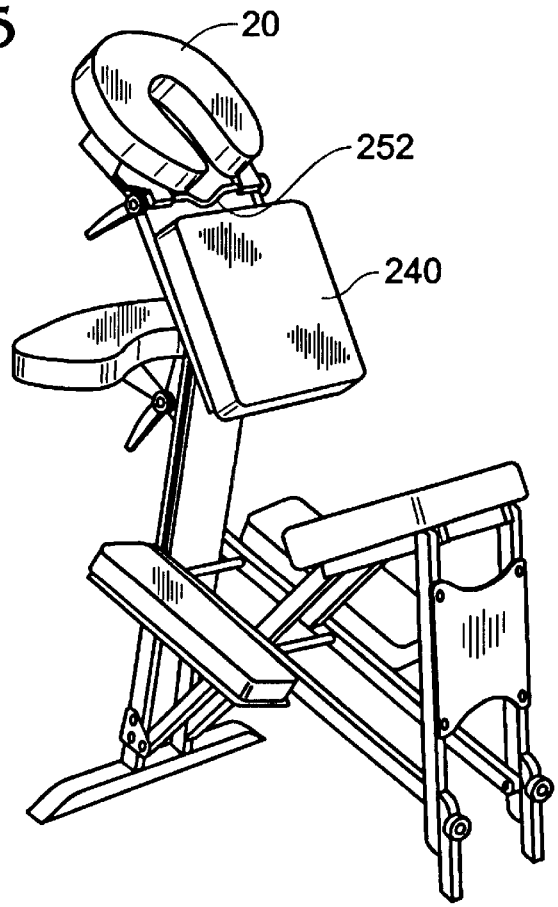
FIG. 5 is a perspective view of an adjustable face rest mounted on a collapsible chair.
Figure 6:
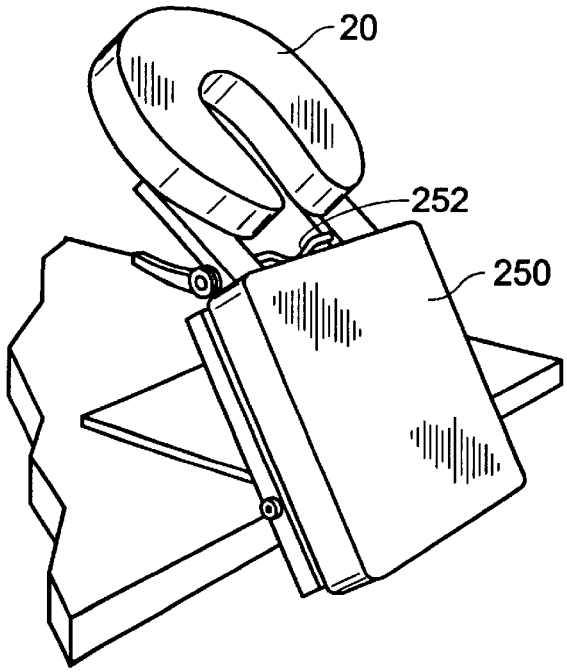
FIG. 6 is a perspective view of an adjustable face rest mounted on a chest support platform designed for mounting on an edge of a table or desk.

FIGS. 4–6 illustrate face rests, as described and illustrated in FIGS. 1A–C, and FIG. 2, mounted on equipment for massage and body working. FIG. 4 shows face rest 20 mounted on collapsible massage table 230. FIG. 5 shows face rest 20 mounted on chair 240. FIG. 6 shows face rest 20 mounted on desk top chest pad 250. Bent cross support member 252 can be seen in FIGS. 5 and 6.

Although the invention has been disclosed in its preferred forms, the specific embodiments thereof as disclosed and illustrated herein are not to be considered in a limiting sense, because numerous variations are possible. Singular terms used herein do not preclude the use of more than one of the associated element, and embodiments utilizing more than one of a particular element are within the spirit and scope of the invention. Applicant regards the subject matter of his invention to include all novel and nonobvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to the original claims, also are regarded as included within the subject matter of applicant's invention.

I claim:

1. A device for supporting a person's head comprising a facial support member having a proximal end, a linkage device configured to secure the support member to a furniture item so that the support member can be free to rotate around a rotational axis located near the proximal end of the support member, plural cooperative clamping devices laterally spaced from each other along the rotational axis, the clamping devices being connected by a cross-member that is angled or curved to avoid interfering with a person's chin.

2. The device of claim 1, wherein the furniture item is a table.

3. The device of claim 1, wherein the furniture item is a chair.

4. The device of claim 1, wherein the furniture item is a chest support device designed for mounting on a table top.

5. The device of claim 1, wherein the support member includes a platform.

6. The device of claim 5, wherein the platform is open in a central region.

7. The device of claim 5, wherein the platform has a cushion for contacting a person's face.

8. The device of claim 1, wherein the support member is contoured to accommodate a person's face.

9. The device of claim 1, wherein the linkage device includes a pair of lateral post members designed to engage a table or a chair.

10. The device of claim 1 further comprising a single handle that coordinates the clamping devices simultaneously.

11. The device of claim 1, wherein each clamping device has a pair of locking disks, rotational freedom of the support member around the rotational axis being locked when the respective pairs of disks are forced together, and rotational freedom of the support member around the rotational axis being permitted when each pair of disks is forced apart.

12. The device of claim 11, wherein the cross-member includes a bent cover tube.

13. The device of claim 12 further comprising a cable connecting the clamping devices and running through the cover tube, whereby tightening of the cable causes the clamping devices to lock and prohibit rotational freedom of the support member around the rotational axis.

14. A device for supporting a person's head comprising a facial support member having a proximal end, a linkage device configured to secure the support member to a furniture item so that the support member can be free to rotate around a rotational axis located near the proximal end of the support member, plural cooperative clamping devices laterally spaced from each other along the rotational axis, a cable connecting the clamping devices, a guide member that holds the cable in a non-linear path to avoid interfering with a person's chin, and a handle that can be manipulated to increase tension in the cable, thereby causing the clamping devices to lock and prohibit freedom of the support member to rotate around the rotational axis.

15. The device of claim 14, wherein the guide member is a bent tube.

16. The device of claim 14, wherein the guide member is a rigid rod member having a groove for seating the cable.

17. The device of claim 14, wherein the furniture item is a table, or a chair, or a chest support member designed to be secured on the edge of a table top.

18. The device of claim 14, wherein the support member includes a platform.

19. The device of claim 18, wherein the platform is open in a central region.

20. The device of claim 18, wherein the platform has a cushion for contacting a person's face.

21. The device of claim 14, wherein the support member is contoured to accommodate a person's face.

22. The device of claim 14, wherein each clamping device has a pair of locking disks, whereby an increase in tension of the cable causes each pair of locking disks to engage and lock.

23. A device for supporting a person's head comprising a facial support member having a proximal end, a linkage device configured to secure the support member to a furniture item so that the support member can be free to rotate around first and second rotational axes located near the proximal end of the support member, a first handle that can be manipulated alternately to lock and unlock rotation of the facial support member around the first rotational axis, and a second handle that can be manipulated alternately to lock and unlock rotation of the facial support member around the second rotational axis, and a non-linear cross support member having ends aligned with the first rotational axis.

* * * * *